US008421359B2

(12) United States Patent
Tanaka et al.

(10) Patent No.: US 8,421,359 B2
(45) Date of Patent: Apr. 16, 2013

(54) DISCHARGE LAMP UNIT HAVING HEAT DISSIPATION STRUCTURE

(75) Inventors: Kenichi Tanaka, Kariya (JP); Yoshihiro Wanda, Okazaki (JP)

(73) Assignee: Denso Corporation, Kariya (JP)

( * ) Notice: Subject to any disclaimer, the term of this patent is extended or adjusted under 35 U.S.C. 154(b) by 324 days.

(21) Appl. No.: 12/800,980

(22) Filed: May 27, 2010

(65) Prior Publication Data

US 2010/0308728 A1 Dec. 9, 2010

(30) Foreign Application Priority Data

Jun. 2, 2009 (JP) ..... 2009-133236

(51) Int. Cl.
*H01J 7/44* (2006.01)

(52) U.S. Cl.
USPC ..... 315/56; 315/77; 315/307

(58) Field of Classification Search ..... 315/56–58, 315/76, 77, 83, 291, 307
See application file for complete search history.

(56) References Cited

U.S. PATENT DOCUMENTS

| | | | | |
|---|---|---|---|---|
| 4,414,615 | A * | 11/1983 | Szeker et al. | 362/264 |
| 2002/0064674 | A1 | 5/2002 | Kadokawa | |
| 2011/0012509 | A1 * | 1/2011 | Wursching et al. | 315/51 |

FOREIGN PATENT DOCUMENTS

| | | |
|---|---|---|
| JP | 3-046387 | 2/1991 |
| JP | 10-064686 | 3/1998 |
| JP | 2000-252664 | 9/2000 |
| JP | 2002-109951 | 4/2002 |
| JP | 2002-171086 | 6/2002 |
| JP | 2002223089 | 8/2002 |
| JP | 2003-22702 | 1/2003 |
| JP | 2003-317535 | 11/2003 |
| JP | 2006-236691 | 9/2006 |
| JP | 2008-210771 | 9/2008 |

OTHER PUBLICATIONS

Notification of Reasons for Rejection dated Jan. 10, 2012 in corresponding JP application No. 2009-133236 with English translation thereof.
Office action dated Dec. 12, 2011 in corresponding Chinese Application No. 2010 10194611.6.
Office action dated Apr. 19, 2011 in corresponding Japanese Application No. 2009-133236.
Office Action issued Oct. 10, 2012 in corresponding Chinese Application No. 2010-10194611.6 with Search Report and English translation.
Office Action mailed Jun. 26, 2012 in corresponding Japanese Application No. 2009-133236 (with English translation).

* cited by examiner

*Primary Examiner* — Don Le
(74) *Attorney, Agent, or Firm* — Harness, Dickey & Pierce, PLC

(57) ABSTRACT

A discharge lamp unit constitutes circuit components including self-heating components that radiate the heat, i.e., a circuit board and a DC/DC transformer, and a heat radiation member. The heat radiation member made of metal is arranged in a portion between the self-heating components and the other components, so as to cover at least a portion of the self-heating component. In the discharge lamp unit, the heat produced by the self-heating components can be absorbed by the heat radiation member before the conducting heat reaches the circuit components other than the self-heat components. As a result, the heat produced by the self-heating components can be effectively radiated away.

11 Claims, 7 Drawing Sheets

DISCHARGE LAMP UNIT HAVING HEAT DISSIPATION STRUCTURE

CROSS REFERENCE TO RELATED APPLICATION

This application is based on and claims the benefit of priority from earlier Japanese Patent Application No. 2009-133236 filed on Jun. 2, 2009, the description of which is incorporated herein by reference.

BACKGROUND OF THE INVENTION

1. Field of the Invention

The present invention related to discharge lamp unit, more particularly, a discharge lamp unit having a supporting member that supports the discharge lamp therein.

2. Description of the Related Art

Conventionally, a discharge lamp unit provided with a supporting member that supports the discharge lamp, circuit components that supply power to the discharge lamp unit (i.e., circuit elements including an inductor, a capacitor and a circuit board including an integrated circuit or IC), and a casing member are known. The casing member is provided with the circuit components being retained inside thereof and the supporting member being exposed outside of the casing member.

As an example of the casing member that constitutes the discharge lamp unit, Japanese patent application laid-open No. 2003-022702 discloses a casing member in which a supporting member side is made of resin having low thermal conductivity and the opposite side of the supporting member is made of metal having high thermal conductivity.

However, in the above-described discharge lamp unit, when the unit includes a self-heating component that radiates heat by itself, the circuit components arranged closely to the self-heating component, are likely to be heated by the heat conducted from the self-heating component which is at high temperature.

SUMMARY OF THE INVENTION

In light of the above-described problem, in the discharge lamp unit having a circuit component used for supplying power to the lamp unit, an object of the present invention is to provide a technique that effectively radiates the heat even when the self-heating component is accommodated within the same casing member.

To achieve the above-described object, a first aspect of the present invention includes a self-heating component that radiates heat produced thereby, and a heat radiation member which is made of metal, arranged at a portion between the self-heating component and other circuit component to cover at least a part of the self-heating component.

According to the above-described discharge lamp unit, the heat produced by the self-heating component can be absorbed by the heat radiation member before the heat conduction reaches the other components. As a result, the heat produced by the self-heating component can be effectively radiated. Note: "the circuit components other than the self-heating components" includes the other self-heating components other than the above-described self-heating component.

As a second aspect of the present invention, the heat radiation member in the discharge lamp unit may be arranged closely to the self-heating component. In the above-described discharge lamp unit configured like this, the heat produced by the self-heating component can readily be conducted to the heat radiation member whereby the self-heating component can be effectively cooled down. When the contact surface area between the heat radiation member and the self-heating component is increased, the self-heating components can effectively radiate the heat similar to when the heat radiation member completely covers the self-heating component.

As a third aspect of the present invention, in the above-described discharge lamp unit, the heat radiation member can be an electrical wiring that electrically connects any of the circuit components and the self-heating component.

In the above-described discharge lamp, existing wiring can be used as a heat radiation member. However, a wiring between the discharge lamp and the circuit components is not be used as the heat radiation member. Hence, conducting heat produced by the discharge lamp to the self-heating component can be avoided.

Moreover, a configuration of the heat radiation member can be adapted to any one of discharge lamp units as described above, i.e., the heat radiation member may be configured by bending a metal material being located in a plane, i.e., a planar metal material.

In the above-described discharge lamp unit configured like this, the heat radiation member can be formed by bending processing so that the heat radiation member can readily be manufactured. Specifically, a metal-made plate, a metal-made plate having at least one hole and a meshed-shape material can be used as 'the metal material being located in a plane'.

When the heat radiation member is configured as a metal plate having a plurality of holes or a meshed material, an amount of material used for manufacturing the radiation member can be reduced compared to manufacturing the same size heat radiation member configured as a simple plate. Further, weight of the heat radiation member can be reduced.

Also, in the above-described discharge lamp units, when the lamp unit is provided with a casing member including a metal portion, holding each circuit component, the heat radiation member may be arranged to be connected to the metal portion in the casing member.

In the above-described discharge lamp unit configured like this, since the heat radiation member is connected to a metal portion in the casing member, the electric potential of the heat radiation member can readily be the same electric potential as the reference electric potential outside of the discharge lamp unit. Specifically, when the discharge lamp unit is mounted on a vehicle such as a passenger car or the like, the electric potential at the heat radiation member can be fixed easily to the reference potential of the vehicle i.e., ground potential. In addition, the heat at the heat radiation member can be radiated outside of the casing member via the casing member.

In addition, in the above-described discharge lamp unit, the self-heating component may be configured as an integrated circuit or a boost converter circuit. Generally, the integrated circuit or the boost converter circuit produces significant heat and noise, therefore, the heat radiation member covering the circuits can prevent conducting heat and emitting noise to other components.

DESCRIPTION OF THE PREFERRED EMBODIMENTS

Figure 1:
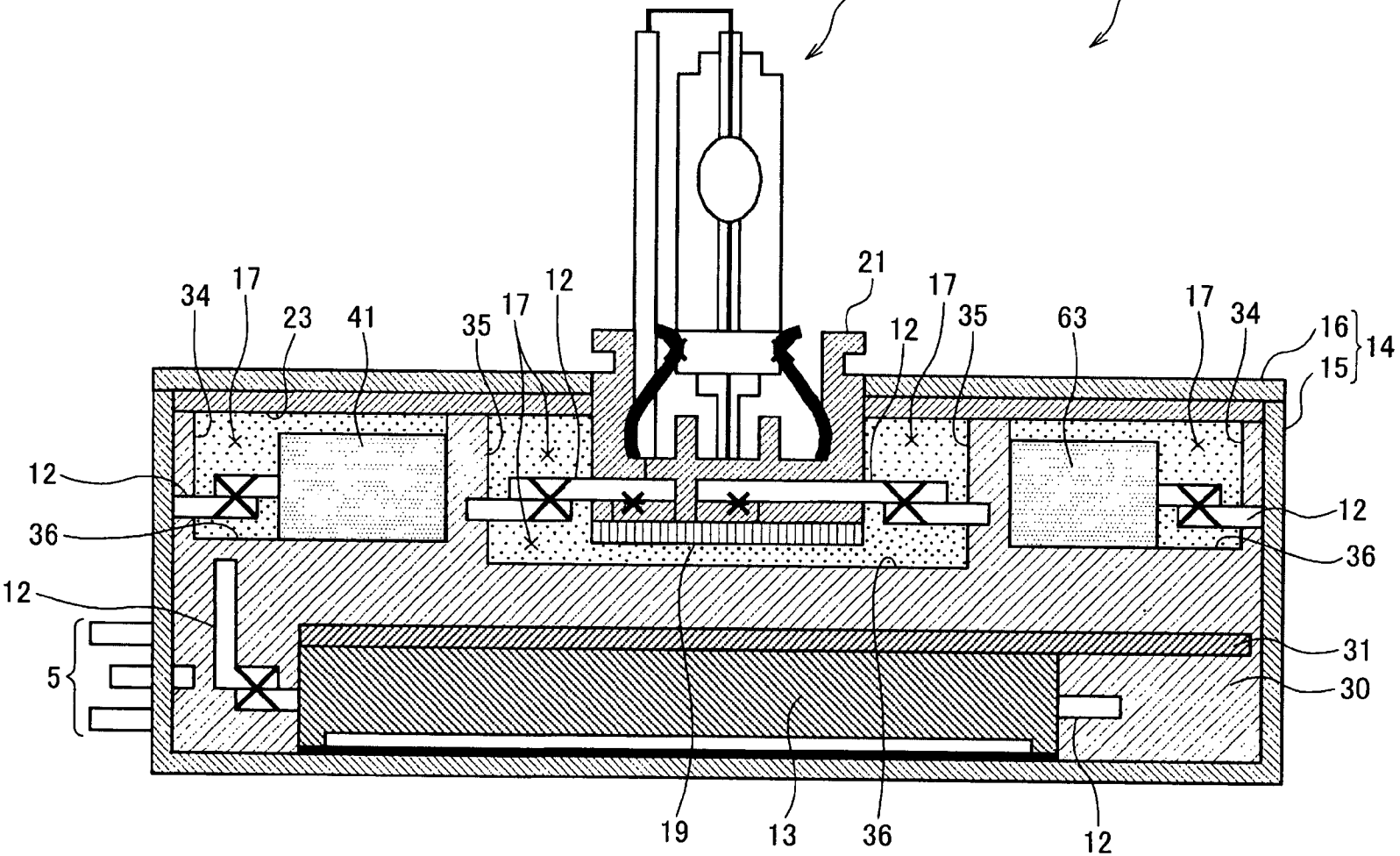
FIG. 1 is a center cross-sectional view showing a discharge lamp unit according to an embodiment of the present invention.

With reference to FIG. 1 to FIGS. 3A and 3B, hereinafter will be described an embodiment according to the present invention. First, the configuration of the embodiment is described with as follows. FIG. 1 illustrates a center cross-sectional view of the discharge lamp unit of the embodiment according to the present invention. As shown in FIG. 1, the discharge lamp unit 1 is provided with a casing member 14 in which various elements (circuit components) are disposed for supplying power to the discharge lamp 11 to be turned on in order to radiate the light.

In particular, the casing member 14 is provided with a circuit board 13 having an integrated circuit as an IC chip, circuit components such as an inductor, a capacitor or the like and an electric wiring 12 that connects these board and components. The casing member 14 holds a supporting member 21 supporting the discharge lamp 11, being exposed towards outside.

Here, the casing member 14 is configured such that a cover member 16 and a main member 15 are butted against each other. The cover member 16 includes the surface on the side on which the supporting member 21 that supports the discharge lamp 11 is exposed (upper side in FIG. 1). The main member 15 is on the circuit board 13 side (lower side in FIG. 1) and does not include the surface on the side on which the supporting member 21 is exposed. In the casing member 14, the main member 15 is configured as an approximately rectangular parallelepiped shape (excluding a portion of the cover member) which is made of metal such as aluminum and serves as an electro-magnetic interference (EMI) shield to prevent external noise from entering the casing member 14 and to prevent noise produced inside of the casing member 14 being leaked outside. Also, the main member 15 serves as a heat sink that radiates heat produced inside of the casing member 14 towards the outside.

Meanwhile, the cover member 16 is made of resin having lower thermal conductivity than metal material. Therefore, the heat produced at the discharge lamp 11 is not conducted to the inside of the casing member 14 easily. However, the cover member 16 may be configured as a metal such as aluminum. In this case, the cover member 16 functions as the EMI shield.

In a portion between the casing member 14 and the supporting member 21, a reflector (not shown) having a concave reflected-surface can be arranged, which reflects the light emitted by the discharge lamp 11 in the forward direction (upper direction in FIG. 1).

The space within the casing member 14 is divided into a plurality of spaces by a molded plastic 30 that is injection-molded into a predetermined shape. The molded plastic 30 is injected into the main member 15 in which a part of components are assembled. In this manufacturing process, an insert-molding is performed in the main member 15.

As described below, a portion at which the circuit components with insert-molded are arranged (i.e., a bottom section of the main member 15 or opposite side of the discharge lamp 11 in the casing member) is called the first level portion and a portion of the discharge lamp 11 side other than the molded plastic 30 (i.e., a portion of the discharge lamp 11 side in the casing member 14) is called the second level portion.

Here, the circuit board 13, the self-heating components such as a DC-DC transformer 46 (described later) and a heat radiation member 31 which is made of metal are arranged in the first level portion in the casing member 14. The heat radiation member 31 is arranged closely so as to cover the self-heating components. The detail explanation of the heat radiation member is given later.

On the other hand, circuit components that produce less heat such as a starter transformer 63 and the supporting member 21 are arranged in the second level portion of the casing member 14. In the second level portion of the casing member 14, numerous bowl-shaped spaces (three spaces in FIG. 1) are formed by side walls 34 and a plurality of partitioning walls 35 of the molded plastic 30 formed in parallel with the light axis direction of the discharge lamp 11.

Each of the bowl-shaped spaces configures a component mounting portion 36 for mounting the circuit components. "Bowl-shaped" refers to a shape including side wall portions (the side wall 34 and the partitioning wall 35) surrounding a bottom portion (a surface of the molded plastic 30 on the supporting member 21 side), in which the side opposing the bottom portion of the side wall portion is open.

In the respective component mounting portion 36, a liquid-state filler 17 such as potting resin or the like is poured after a predetermined circuit components are disposed. The supporting member 21 is formed integrally with a resin cover 23 that covers at least some of the component mounting portion 36 and the supporting member 21 is positioned by the resin cover 23 being mounted on the side walls 34 and the partitioning walls 35.

According to the present embodiment, a heat-insulating material 19 having lower thermal conductivity than ordinary metals and resins is disposed on the surface opposite to the light axis of the supporting member 21 (lower side in FIG. 1). The above-mentioned filling material 17 fills the area between the heat-insulating material 19 and the molded plastic 30.

In the discharge lamp unit 1 as described above, a wiring used for the supplying power is connected to a connector 5 being formed around the casing member 14 projecting towards outside. Hence, powering the discharge lamp unit 1 by the wiring, the discharge lamp unit 1 can be operated. The supporting member 21 and the resin cover 23 are preferably formed by a material having further lower thermal conductivity, such that the supporting member 21 blocks conductive heat from the discharge lamp 11 and the resin cover 23 blocks the radiant heat induced by the discharge lamp 11.

Figure 2:
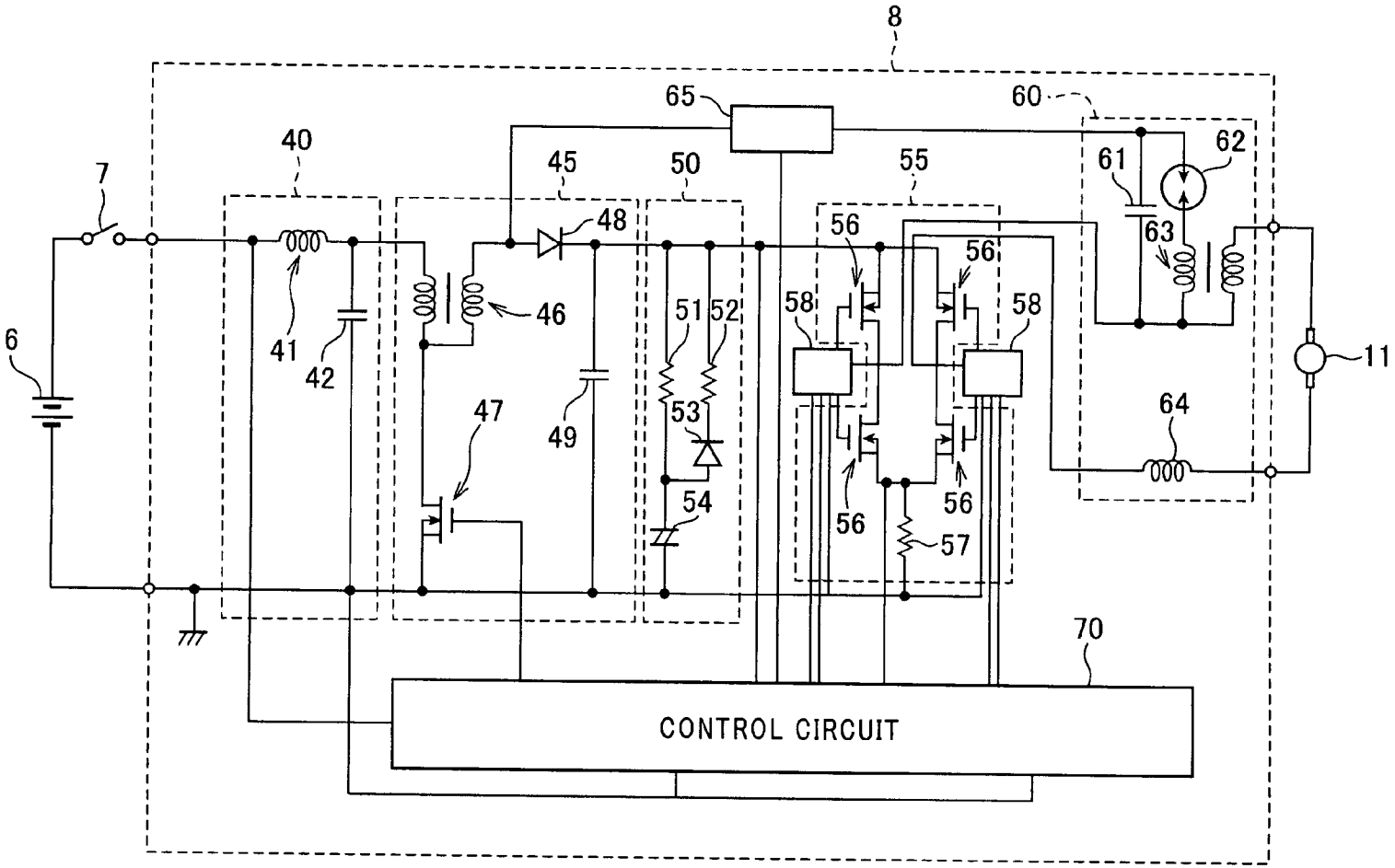
FIG. 2 is a circuit diagram showing a light-emitting circuit that controls emitting the discharge lamp unit.

Next, a circuit configuration configuring the discharge lamp unit 1 will be described with reference to FIG. 2. FIG. 2 is a circuit diagram of a light-emitting circuit 3 that lights the discharge lamp 11. As shown in FIG. 2, a battery 6 and a switch 7 are provided outside of the discharge lamp unit 1. Power from the battery 6 is supplied to the discharge lamp unit 1 by an operator turning ON the switch 7.

As shown in FIG. 2, the light-emitting circuit 3 of the discharge lamp unit 1 includes a filter circuit 40, a direct current/direct current (DC/DC) converter circuit 45, a lighting auxiliary circuit 50, a H-bridge circuit 55 (a type of bridge circuit, so-called H-bridge), a high-voltage generation circuit 60, and a control circuit 70.

The filter circuit 40 includes an input coil 41 and an input capacitor 42. The filter circuit 40 is configured to serve as a smoothing circuit that smoothes power supply voltage received from the battery 6.

The DC/DC converter circuit 45 includes a DC/DC transformer 46, a power metal-oxide semiconductor (MOS) transistor 47 that is a power device, a diode 48, and a capacitor 49. The DC/DC converter circuit 45 is configured to serve as a converter circuit that boosts the power supply voltage (such as 12V) to a lamp supply voltage (such as 40V).

The lighting auxiliary circuit 50 includes two resistors 51 and 52, a diode 53, and a storage capacitor 54. The resistors 51 and 52 are connected in parallel to a power supply side terminal. The diode 53 is serially connected to one resistor 52. The storage capacitor 54 is connected to the other resistor 51 and the diode 53. The lighting auxiliary circuit 50 is a circuit that temporarily supplies power required to light the discharge lamp 11. The storage capacitor 54 provides a function for storing required power.

The H-bridge circuit 55 includes four power transistors 56 and a resistor 57 disposed to serve as a current detection resistor. The H-bridge circuit 55 is controlled by drivers 58 that receive operating signals from the control circuit 70 and turn ON and OFF power transistors 56. As a result of the control by the drivers 58, output from the H-bridge circuit 55 is converted from direct current to alternating current (which, however, has a rectangular waveform).

The high-voltage generation circuit 60 includes a high-voltage generation capacitor 61, a spark gap 62, a starter transformer 63, and a noise reduction coil 64. The high-voltage generation capacitor 61 charges the current flowing to the primary coil side of the starter transformer 63. The spark gap 62 switches the discharge of the high-voltage generation capacitor 61.

Then, the starter transformer 63 generates a starting voltage (such as 25 kV) for initiating lighting of the discharge lamp 11. A high voltage from a boosting circuit 65 that receives operating signals from the control circuit 70 is applied to the spark gap 62, and the spark gap 62 conducts power when the voltage applied to the spark gap 62 reaches a predetermined voltage. The control circuit 70 includes a semiconductor device that controls circuit elements.

Figure 3A:
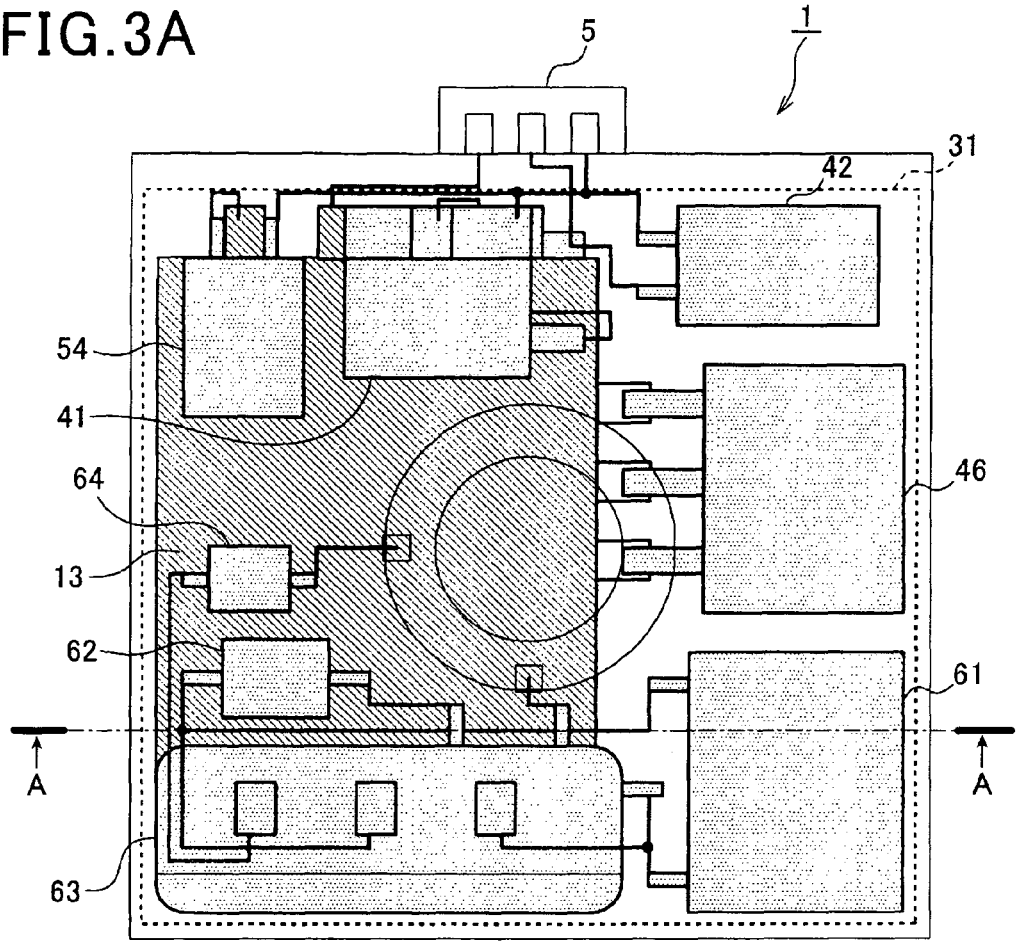
FIGS. 3A to 3B are an explanatory diagram showing an arrangement of the components in the discharge lamp unit according to the embodiment.
Figure 3B:
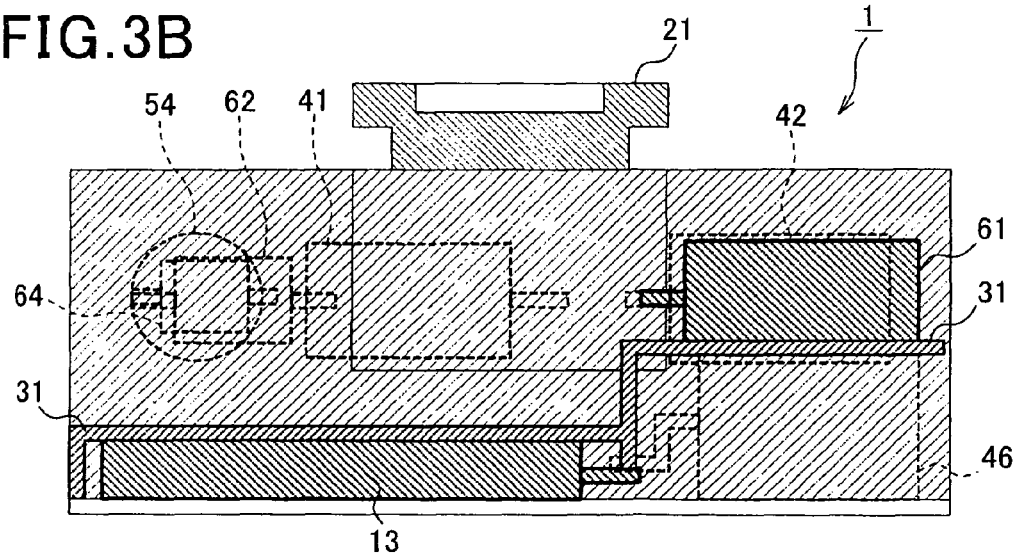

The circuit components within the light-emitting circuit 8, such as the control circuit 70, the H-bridge circuit 55, and the drivers 58, are mounted on the above-described circuit board 13. Next, detail arrangement of the circuit components that constitutes the light-emitting circuit 8 in the casing member 14 is described with reference to the FIGS. 3A to 3B. FIG. 3A is an explanatory diagram showing a perspective view of the casing member 14 from the discharge lamp 11 side. FIG. 3B is a cross-sectional view at A-A section of the FIG. 3A.

As shown in FIG. 3A, in the casing member 14, the input coil 41 and the input capacitor 42 which constitutes the filter circuit 40 are disposed closely to the connector 5. The storage capacitor 54 being connected to the ground terminal is disposed closely to the connector 5 in parallel with the input coil 41. By this arrangement, the filter circuit 40 is disposed closely to the connector 5 that has a function for noise reduction whereby the noise at the connector 5 propagating inside of the casing member can be avoided.

The high-voltage generation capacitor 61 and the starter transformer 63 that constitutes the high-voltage generation circuit 60 are arranged in the same portion which is apart from the connector 5. Similarly, the spark gap 62 and the noise reduction coil 64 that constitutes the high-voltage generation circuit 60 are arranged right above the circuit board 13 and arranged closely to the starter transformer 63.

Since almost of the circuit components of the high-frequency generation circuit 60 are arranged in the second level portion that is close to the supporting member 21, length of a wiring between the high-frequency generation circuit 60 and the supporting member 21 can be shortened. As a result, conducting noise generated by the high-frequency circuit to the other circuit components can be prevented.

Further, as shown in FIG. 3B, within the circuit components, the self-heating components such as the circuit board 13 and the DC-DC transformer 46 are disposed in the first level portion. The heat radiation member 31 made of metal is disposed at a region between these circuit components being arranged in the first level portion and circuit components being arranged in the second level portion. The heat radiation member 31 is disposed so as to cover a surface at a front side of the light axis direction of the discharge lamp 11 in the circuit board 13 and the DC/DC transformer 46 (i.e., upper side surface in FIG. 3B). Also, the heat radiation member 31 is disposed in contact with the circuit board 13 and the DC/DC transformer 46.

Moreover, the heat radiation member 31 is configured as a ground-wiring that electrically connects the circuit board 13 and the other circuit components Further, one end of the heat radiation member 31 is connected to a metal portion in the casing member 14 (the main member 15). Hence, when the main member 15 is disposed in contact with a terminal that owns the reference potential of the vehicle, the electrical potential of the heat radiation member is fixed to the reference potential of the vehicle (ground potential) without any wiring.

Figure 7A:
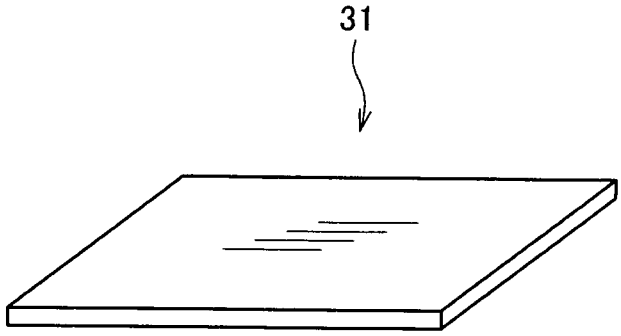
FIGS. 7A to 7C are a diagram showing a surface of a heat radiation member.

The heat radiation member 31 is configured by bending a rectangular plate made of metal being located in a plane (refer to FIG. 7A). As shown in FIG. 3A, as a dashed line indicates, the heat radiation member 31 is arranged to cover a whole area of the first level portion at which the heat-radiation member are disposed.

The advantages according to this embodiment will be explained as follows. In the discharge lamp unit 1 as described in detail, the heat radiation member 31 is provided in a portion between the self-heating components and the other circuit components. The heat radiation member 31 made of metal at least partially covers the self-heating components. The self-heating components radiate the heat and include the circuit board 13 and DC/DC transformer 46 or the like.

In the discharge lamp unit 1 according to the embodiment, the heat generated by the self-heating components can be absorbed by the heat radiation member 31 before the heat is conducted to the circuit components other than the self-heating components. Therefore, the heat generated by the self-heating components, can be effectively radiated. Also, the heat radiating member 31 can prevent the noise generated by the self-heating components from conducting to external components. Further, the heat radiating member 31 can serve as a noise shield that prevents the self-heating components suffering from noise generated by the external components.

Moreover, in the discharge lamp unit 1, the heat-radiation member 31 is disposed in contact with the self-heating member. According to the discharge lamp unit 1 configured like this, the heat generated by the self-heating components can be conducted easily to the heat radiation member 31. As a result, the self-heating component can be effectively cooled down.

In the discharge lamp unit 1, the heat radiation member 31 is configured as a wiring that electrically connects any of the circuit components and the self-heating components. Accordingly, the existing wiring can be used as a heat radiation member 31.

Moreover, in the discharge lamp unit 1, the heat radiation member 31 is configured by bending a metal material being located in a plane. Accordingly, the heat radiation member 31 can be formed by bending processing whereby manufacturing the heat radiation member can be simplified.

Also, in the discharge lamp unit 1, at least some of the portion is made of metal and the discharge lamp unit lincludes the casing member 14 that holds each circuit component therein. The heat radiation member 31 is connected to a metal portion in the casing member 14 (main member 15).

Therefore, in the discharge lamp unit 1 configured like this, the heat radiation member 31 is connected to the metal portion of the casing member whereby the electric potential of the heat radiation member can readily be the same electric potential of the reference electric potential outside of the discharge lamp unit. Specifically, when the discharge lamp unit 1 is mounted on a vehicle such as a passenger car or the like, the electric potential at the heat radiation member 31 can be fixed easily to the reference potential of the vehicle i.e., ground potential.

In addition, in the discharge lamp unit, the self-heating component is configured as the circuit board or the DC/DC transformer 46. Generally, the circuit board or the DC/DC transformer easily produces much noise. Therefore, when these circuits are covered by the heat radiation member, conducting heat and the noise can be significantly reduced.

(Other Embodiments)

The present invention is not limited to above-described embodiment. Various modifications can be made within the spirit of the invention.

(First Modification)

Figure 4A:
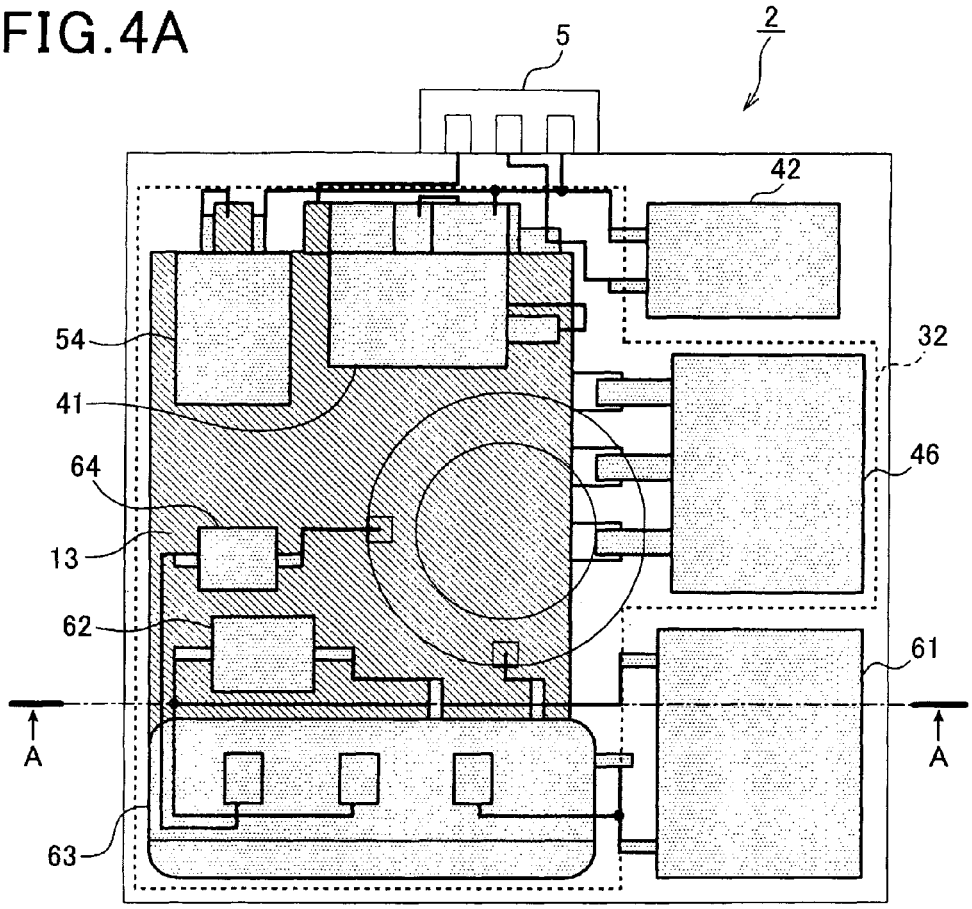
FIGS. 4A to 4B are an explanatory diagram showing an arrangement of the components in the discharge lamp unit according to a first modification.
Figure 4B:
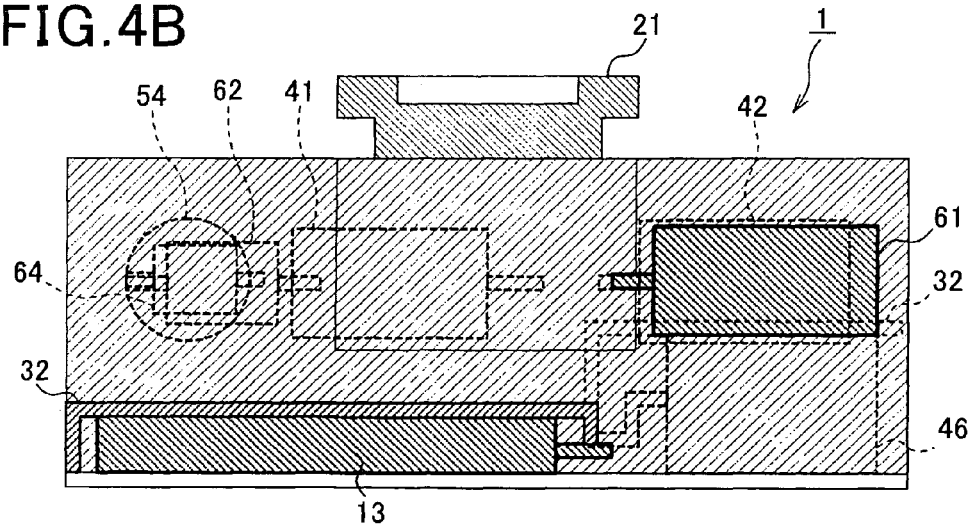

Specifically, in the above-described embodiments, the heat radiation member 31 is arranged so as to cover the circuit board in the first level portion and the circuit components such as DC/DC transformer 46 or the like. However, as an alternative type of heat radiation member 32 can be configured using a plate having a predetermined processed shape. As shown in FIGS. 4A and 4B, the heat radiation member 32 may be arranged so as to cover only circuit components that generate much heat and noise (i.e., circuit board 13 and DC/DC transformer 46). As a result, a material used for the heat radiation member 32 can be reduced.

(Second Modification)

Figure 5A:
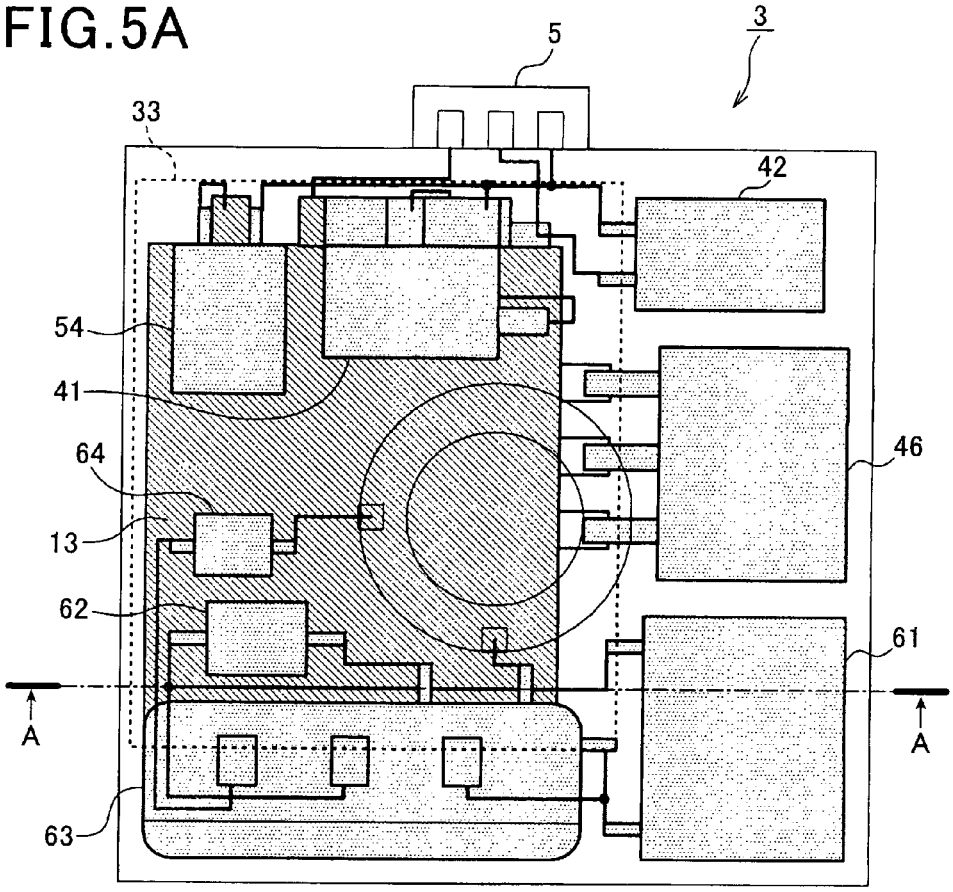
FIGS. 5A to 5B are an explanatory diagram showing an arrangement of the components in the discharge lamp unit according to a second modification.
Figure 5B:
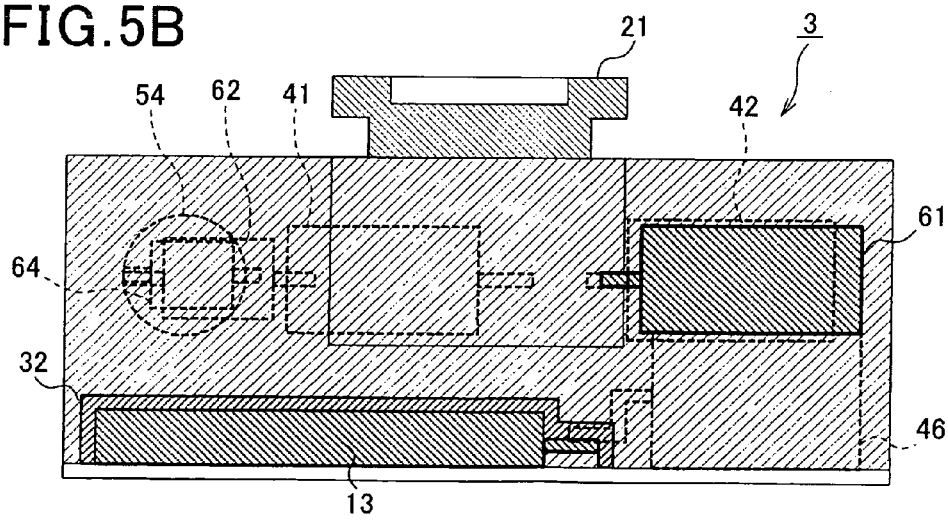

Further, as an alternative heat radiation member 33, as shown in FIG. 5A and 5B, in addition to covering the circuit components that generate much heat and noise (here, circuit board 13), the heat radiation member 33 can be arranged so as to cover entire area of the circuit components including the periphery of the components. As a result, only the circuit components that specifically require accuracy of operation can be selectively protected.

(Third Modification)

Figure 6:
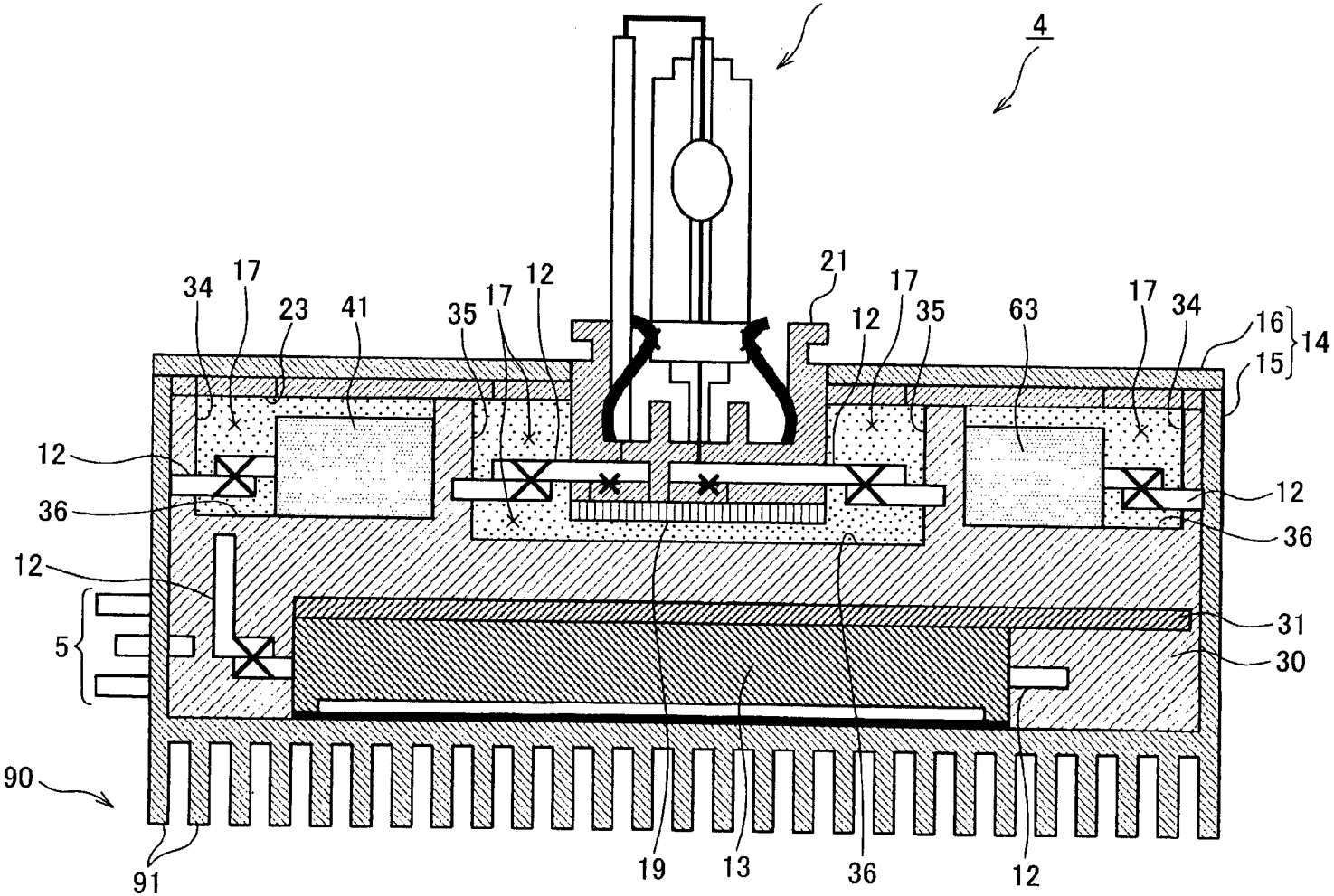
FIG. 6 is a center cross-sectional view showing a discharge lamp unit according to a third modification.

Further, as shown FIG. 6, a discharge lamp unit 4 may be configured. Specifically, in the discharge lamp unit 4, the main member 15 of the casing member 14 is provided with a heat radiation member 90 (heat radiation portion) having a plurality of concave-convex portion so as to increase the surface area and a projection portion (i.e., a plurality of fin 91). Since the heat radiation member 90 has large surface area, the area being exposed to the air of the heat radiation member 90 is increased. As a result, the heat conducted to the casing member 14 can readily be radiated to the ambient atmosphere. Also, since the heat radiation member is contact with the casing member 14, when the heat radiation of the casing member is enhanced, the heat generated by the self-heating components can reliably be radiated through the heat radiation member and the casing member 14.

Figure 7B:
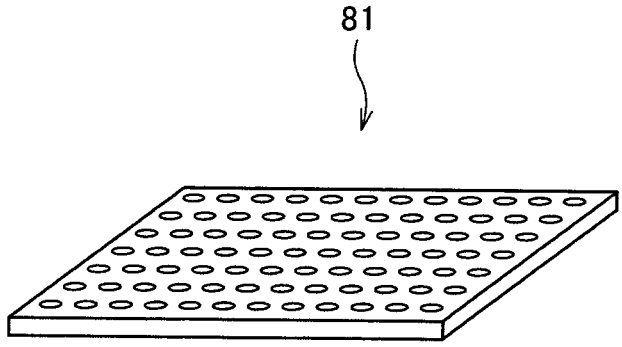
Figure 7C:
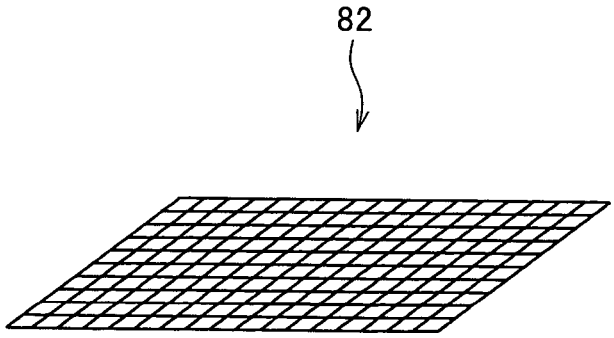

According to the above-described embodiment, the heat radiation member 31 is configured by using the metal plate material. However, as shown in FIG. 7B, the heat radiation member 31 may be configured by using a metal plate having at least one hole or may be configured by using a meshed-shape material as shown in FIG. 7C.

According to a modification of the discharge lamp unit in which the heat radiation member 31 is configured as the metal plate having at least one hole or a meshed-shape material, amount of the material used for manufacturing the heat radiation member can be reduced, or weight of the heat radiation member can be reduced, compared to a discharge lamp unit having a heat radiation member using a simple metal plate.

What is claimed is:

1. A discharge lamp unit comprising:

a discharge lamp radiating light;

a plurality of circuit components including a self-heating component that radiates heat produced thereby, supplying power to the discharge lamp unit;

a heat radiation member capable of radiating the heat produced by the self-heating component having a first surface facing the self-heating component and a second surface facing other circuit components, the heat radiation member being made of metal and arranged at a portion between the self-heating component and the other circuit components so as to at least partly cover the self-heating component, at the first surface of the heat radiation member;

a molded member arranged so as to cover the second surface of the heat radiation member;

a casing member holding the circuit components therein, including a metal portion where the heat radiation member is connected thereto; and a partitioning member comprising the heat radiation member and the molded member, the partitioning member partitioning between a portion at which the self-heating component is arranged and a portion at which other circuit components are arranged and partitioning between a portion at which the discharge lamp is disposed and a portion at which the self-heating component is disposed, wherein the self-heating component contacts the metal portion of the casing member and the heat-radiation member, and the self-heating component is arranged to be sandwiched by the metal portion of the casing and the heat radiation member, and the molded member includes a partitioning wall that partitions a portion at which the discharge lamp unit is disposed and a portion at which a circuit component is disposed.

2. The discharge lamp unit according to claim 1, wherein the heat radiation member is configured as an electrical wiring that electrically connects any one of the circuit components and the self-heating component.

3. The discharge lamp unit according to claim 1, wherein the heat radiation member is configured by bending a planar metal material.

4. The discharge lamp unit according to claim 2, wherein the heat radiation member is configured by bending a planar metal material.

5. The discharge lamp unit according to claim 1, wherein the heat radiation member is configured by using a meshed-shape material.

6. The discharge lamp unit according to claim 2, wherein the heat radiation member is configured by using a meshed-shape material.

7. The discharge lamp unit according to claim 3, wherein the heat radiation member is configured by using a meshed-shape material.

8. The discharge lamp unit according to claim 1, wherein the self-heating component is configured as an integrated circuit or a boost converter circuit.

9. The discharge lamp unit according to claim 2, wherein the self-heating component is configured as an integrated circuit or a boost converter circuit.

10. The discharge lamp unit according to claim 3, wherein the self-heating component is configured as an integrated circuit or a boost converter circuit.

11. The discharge lamp unit according to claim 1, wherein the heat radiation member completely covers a surface of the self-heating component that faces the first surface.

* * * * *